US009352921B2

(12) United States Patent
Krautkramer et al.

(10) Patent No.: US 9,352,921 B2
(45) Date of Patent: May 31, 2016

(54) METHOD AND APPARATUS FOR APPLYING ADHESIVE TO A MOVING WEB BEING WOUND INTO A ROLL

(71) Applicant: Kimberly-Clark Worldwide, Inc., Neenah, WI (US)

(72) Inventors: Kyle A. Krautkramer, Freedom, WI (US); Matthew Robert Wilson, Oshkosh, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 214 days.

(21) Appl. No.: 14/225,653

(22) Filed: Mar. 26, 2014

(65) Prior Publication Data

US 2015/0274471 A1 Oct. 1, 2015

(51) Int. Cl.

*B65H 19/29* (2006.01)
*B65H 75/28* (2006.01)
*B65H 18/22* (2006.01)

(52) U.S. Cl.

CPC ..... *B65H 19/29* (2013.01); *B65H 18/22* (2013.01); *B65H 75/28* (2013.01); *B65H 2301/414421* (2013.01); *B65H 2301/414433* (2013.01); *B65H 2301/414443* (2013.01)

(58) Field of Classification Search

CPC ..... B65H 19/29; B65H 75/28; B65H 75/285; B65H 2301/414421; B65H 2301/414443
USPC ..... 156/184, 185, 187, 191; 242/520–548
See application file for complete search history.

(56) References Cited

U.S. PATENT DOCUMENTS

| | | | |
|---|---|---|---|
| 125,597 | A | 4/1872 | Mayall |
| 1,648,990 | A | 11/1927 | Little |
| 1,894,253 | A | 1/1933 | McCarthy et al. |
| 2,326,173 | A | 8/1943 | Russell |
| 2,328,582 | A | 9/1943 | Ratchford et al. |
| 2,913,098 | A | 11/1959 | Zellinsky et al. |
| 2,979,278 | A | 4/1961 | Jones |
| 3,123,315 | A | 3/1964 | Couzens |
| 3,148,843 | A | 9/1964 | Turner et al. |

(Continued)

FOREIGN PATENT DOCUMENTS

| | | |
|---|---|---|
| CH | 476620 | 9/1969 |
| DE | 3920659 A1 | 1/1999 |

(Continued)

OTHER PUBLICATIONS

Japanese Abstract of JPH04249177(A) dated Sep. 4, 1992, 2 pages.

(Continued)

*Primary Examiner* — Carson Gross
(74) *Attorney, Agent, or Firm* — Dority & Manning, P.A.

(57) ABSTRACT

A winder for winding a web to produce a rolled product is provided. Included in one exemplary embodiment is a plurality of independent winding modules. The winding modules may be configured to wind the web to form a rolled product by center winding, surface winding, and/or combinations of center and surface winding. In accordance with the present disclosure, at least one tail sealing apparatus is present in the system. The tail sealing apparatus includes an applicator device that transfers adhesive to a web being wound prior to completion of the roll. In one embodiment, the applicator device remains in contact with the wound roll during the completion of the winding cycle in order to have an ironing effect on the finished roll.

13 Claims, 14 Drawing Sheets

(56) References Cited

U.S. PATENT DOCUMENTS

| | | | |
|---|---|---|---|
| 3,157,371 | A | 11/1964 | Billingsley |
| 3,315,908 | A | 4/1967 | Wetzler |
| 3,430,881 | A | 3/1969 | Ebneter |
| 3,519,214 | A | 7/1970 | Konrad et al. |
| 3,733,035 | A | 5/1973 | Schott, Jr. |
| RE28,353 | E | 3/1975 | Nytsrand |
| 3,869,095 | A | 3/1975 | Diltz |
| 4,034,928 | A | 7/1977 | McDonald et al. |
| 4,087,319 | A | 5/1978 | Linkletter |
| 4,133,495 | A | 1/1979 | Dowd |
| 4,139,164 | A | 2/1979 | Alfio |
| 4,143,828 | A | 3/1979 | Braun et al. |
| 4,191,341 | A | 3/1980 | Looser |
| 4,283,023 | A | 8/1981 | Braun et al. |
| 4,327,876 | A | 5/1982 | Kuhn |
| 4,529,141 | A | 7/1985 | McClenathan |
| 4,541,583 | A | 9/1985 | Forman et al. |
| 4,583,698 | A | 4/1986 | Nistri et al. |
| 4,588,138 | A | 5/1986 | Spencer |
| 4,637,566 | A | 1/1987 | Kyytsonen |
| 4,723,724 | A | 2/1988 | Bradley |
| 4,856,725 | A | 8/1989 | Bradley |
| 4,930,711 | A | 6/1990 | Morizzo |
| 4,962,897 | A | 10/1990 | Bradley |
| 4,988,052 | A | 1/1991 | Urban |
| 5,000,395 | A | 3/1991 | Welp et al. |
| 5,054,708 | A | 10/1991 | Wiggers |
| 5,137,225 | A | 8/1992 | Biagiotti |
| 5,169,084 | A | 12/1992 | Pötter et al. |
| 5,226,612 | A | 7/1993 | Mülfarth |
| 5,346,150 | A | 9/1994 | Volin |
| 5,379,964 | A | 1/1995 | Pretto et al. |
| 5,402,960 | A | 4/1995 | Oliver et al. |
| 5,421,536 | A | 6/1995 | Hertel et al. |
| 5,437,417 | A | 8/1995 | Kammann |
| 5,497,959 | A | 3/1996 | Johnson et al. |
| 5,505,402 | A | 4/1996 | Vigneau |
| 5,518,200 | A | 5/1996 | Kaji et al. |
| 5,531,396 | A | 7/1996 | Kinnunen et al. |
| 5,593,545 | A | 1/1997 | Rugowski et al. |
| 5,746,379 | A | 5/1998 | Shimizu |
| 5,832,696 | A | 11/1998 | Nagy et al. |
| 5,839,688 | A | 11/1998 | Hertel et al. |
| 5,901,918 | A | 5/1999 | Klerelid et al. |
| 5,918,830 | A | 7/1999 | Veräjänkorva et al. |
| 5,934,602 | A | 8/1999 | Jendroska et al. |
| 5,944,273 | A | 8/1999 | Lin et al. |
| 5,979,729 | A | 11/1999 | Schmidt et al. |
| 5,979,818 | A | 11/1999 | Perini et al. |
| 6,047,916 | A | 4/2000 | Onnerlov |
| 6,050,469 | A | 4/2000 | Brabant et al. |
| 6,056,229 | A | 5/2000 | Blume et al. |
| 6,062,507 | A | 5/2000 | Summey, III |
| 6,077,590 | A | 6/2000 | Archer et al. |
| 6,142,407 | A | 11/2000 | McNeil et al. |
| 6,264,132 | B1 | 7/2001 | Menz et al. |
| 6,270,629 | B1 | 8/2001 | Hill et al. |
| 6,283,402 | B1 | 9/2001 | Fordham |
| 6,308,909 | B1 | 10/2001 | McNeil et al. |
| 6,311,921 | B1 | 11/2001 | Möller et al. |
| 6,332,589 | B1 | 12/2001 | Leitenberger et al. |
| 6,523,775 | B2 | 2/2003 | Fan |
| 6,595,458 | B1 | 7/2003 | Biagiotti |
| 6,729,572 | B2 | 5/2004 | Baggot et al. |
| 6,758,923 | B2 | 7/2004 | Butterworth et al. |
| 6,871,814 | B2 | 3/2005 | Daul et al. |
| 6,877,689 | B2 | 4/2005 | Butterworth |
| 6,945,491 | B2 | 9/2005 | Gambini |
| 7,000,864 | B2 | 2/2006 | McNeil et al. |
| 7,175,127 | B2 | 2/2007 | Butterworth et al. |
| 7,775,476 | B2 | 8/2010 | Recami et al. |
| 7,846,286 | B2 | 12/2010 | Gelli |
| 7,874,509 | B2 | 1/2011 | Kenney |
| 7,909,282 | B2 | 3/2011 | Wojcik et al. |
| 8,042,761 | B2 | 10/2011 | Wojcik et al. |
| 8,210,462 | B2 | 7/2012 | Wojcik et al. |
| 8,262,011 | B2 | 9/2012 | Wojcik et al. |
| 8,302,650 | B2 * | 11/2012 | Gambini ..... B65H 19/29 118/208 |
| 8,364,290 | B2 | 1/2013 | Pigsley |
| 8,459,587 | B2 | 6/2013 | Wojcik et al. |
| 2010/0163666 | A1 | 7/2010 | Gambini |

FOREIGN PATENT DOCUMENTS

| | | | |
|---|---|---|---|
| EP | 0118384 | A1 | 9/1984 |
| EP | 0313859 | A2 | 5/1989 |
| FR | 2669013 | | 5/1992 |
| WO | WO 9852857 | A1 | 11/1998 |
| WO | WO 0066470 | | 11/2000 |

OTHER PUBLICATIONS

International Search Report and Written Opinion for PCT/IB2015/052116, dated Jul. 7, 2015, 9 pages.

* cited by examiner

METHOD AND APPARATUS FOR APPLYING ADHESIVE TO A MOVING WEB BEING WOUND INTO A ROLL

BACKGROUND

Winders are machines that roll lengths of paper, commonly known as paper webs, into rolls. These machines are capable of rolling lengths of web into rolls at high speeds through an automated process.

Turret winders are well known in the art. Conventional turret winders comprise a rotating turret assembly which support a plurality of mandrels for rotation about a turret axis. The mandrels travel in a circular path at a fixed distance from the turret axis. The mandrels engage hollow cores upon which a paper web can be wound. Typically, the paper web is unwound from a parent roll in a continuous fashion, and the turret winder rewinds the paper web onto the cores supported on the mandrels to provide individual, relatively small diameter logs. The rolled product log is then cut to designated lengths into the final product. Final products typically created by these machines and processes are toilet tissue rolls, paper toweling rolls, paper rolls, and the like.

The winding technique used in turret winders is known as center winding. A center winding apparatus, for instance, is disclosed in U.S. Pat. Reissue No. 28,353 to Nystrand, which is incorporated herein by reference. In center winding, a mandrel is rotated in order to wind a web into a roll/log, either with or without a core. Typically, the core is mounted on a mandrel that rotates at high speeds at the beginning of a winding cycle and then slows down as the size of the rolled product being wound increases, in order to maintain a constant surface speed, approximately matching web speed. Center winders work well when the web that is being wound has a printed, textured, or slippery surface. Also, typically, center winders are preferable for efficiently producing soft-wound, higher bulk rolled products.

A second type of winding is known in the art as surface winding. A machine that uses the technique of surface winding is disclosed in U.S. Pat. No. 4,583,698. Typically, in surface winding, the web is wound onto the core via contact and friction developed with rotating rollers. A nip is typically formed between two or more co-acting roller systems. In surface winding, the core and the web that is wound around the core are usually driven by rotating rollers that operate at approximately the same speed as the web speed. Surface winding is preferable for efficiently producing hard-wound, lower bulk rolled products.

A winding or rewinder system that can use both center winding and surface winding is disclosed in U.S. Pat. No. 8,459,587, U.S. Pat. No. 8,364,290, U.S. Pat. No. 8,262,011, U.S. Pat. No. 8,210,462, U.S. Pat. No. 8,042,761, and U.S. Pat. No. 7,909,282, which are all incorporated herein by reference. The rewinder system disclosed in the above patents has provided great advances in the art. In particular, the rewinder system disclosed in the above patents is capable of not only rapidly and efficiently producing spirally wound rolls of material, but the system is also capable of continuous operation even when a web break fault occurs.

During the production of spirally wound rolls, a "tail seal" process is typically carried out where the trailing end or "tail" of the spirally wound roll is adhered to the surface of the roll in order to prevent the spirally wound product from unraveling during handling and packaging. In many production processes, the tail seal procedure occurs offline after the spirally wound roll has been formed. Tail sealing occurs offline so that the procedure does not interfere with the formation of the rolls. Such offline processes, however, not only create extra process and handling steps, but additional measures are typically needed for tail control during and after winding.

In the past, online tail sealing processes have also been proposed. These processes, however, tend to slow down the process and reduce throughput.

In view of the above, a need exists for a method and apparatus that is capable of applying a tail sealing adhesive online during the production of spirally wound rolls. In particular, a need exists for a method and apparatus for tail sealing that can operate at the same speed at which the rolls are being produced.

SUMMARY

The present disclosure is generally directed to a method and apparatus for adhering the tail portion of a web to a spirally wound roll made from the web. Of particular advantage, in one embodiment, the apparatus can be incorporated into a rewinder or winder system so that the tail sealing method can occur in-line. In one embodiment, in addition to applying an adhesive to a tail portion of the web, the apparatus also controls the tail portion during the end of the winding cycle and provides an ironing mechanism after the adhesive has been applied.

In one embodiment, the method includes spirally winding a web into a roll. For instance, the web can be unwound from a parent roll onto a rotating core for producing the spirally wound roll. In accordance with the present disclosure, an adhesive is applied to the surface of an applicator device. In one embodiment, the surface of the applicator device may comprise the surface of a rotatable applicator roll.

The applicator device moves from a non-engagement position to an engagement position. For instance, the adhesive can be applied to the applicator device in the non-engagement position. When moved to the engagement position, the surface of the applicator device may contact a surface of the spirally wound roll while winding of the web onto the roll continues. The surface of the applicator device moves with the rotating roll and transfers adhesive to the roll.

Contact between the surface of the applicator device and a surface of the rotating roll is maintained as a trailing edge of the web is wound on the roll to produce a completed roll. In this manner, the adhesive is applied in between the outer two layers of the wound roll while the applicator device may, in one embodiment, serve to remove any irregularities, such as puckers or crinkles in the web, while the trailing edge is secured to the roll.

The present disclosure is also directed to an apparatus for applying an adhesive to a moving web being wound into a roll. The apparatus includes an applicator roll connected to an applicator support. The applicator support is configured to move the applicator roll from a non-engagement position to an engagement position. An adhesive applicator is positioned to apply an adhesive to the surface of the applicator roll. For example, in one embodiment, the adhesive applicator may apply an adhesive to the applicator roll in the non-engagement position while the applicator roll is stationary. The apparatus further includes a driving device in operative association with the applicator roll for rotating the applicator roll. For example, the driving device can rotate the applicator roll after application of the adhesive and prior to contact with a moving web. In this manner, the applicator roll can have a velocity that substantially matches the velocity of the moving web during contact such that the applicator roll does not interfere with the process of producing a spirally wound product.

Other features and aspects of the present disclosure are discussed in greater detail below.

BRIEF DESCRIPTION OF THE DRAWINGS

A full and enabling disclosure of the present disclosure is set forth more particularly in the remainder of the specification, including reference to the accompanying figures, in which.

Figure 1:
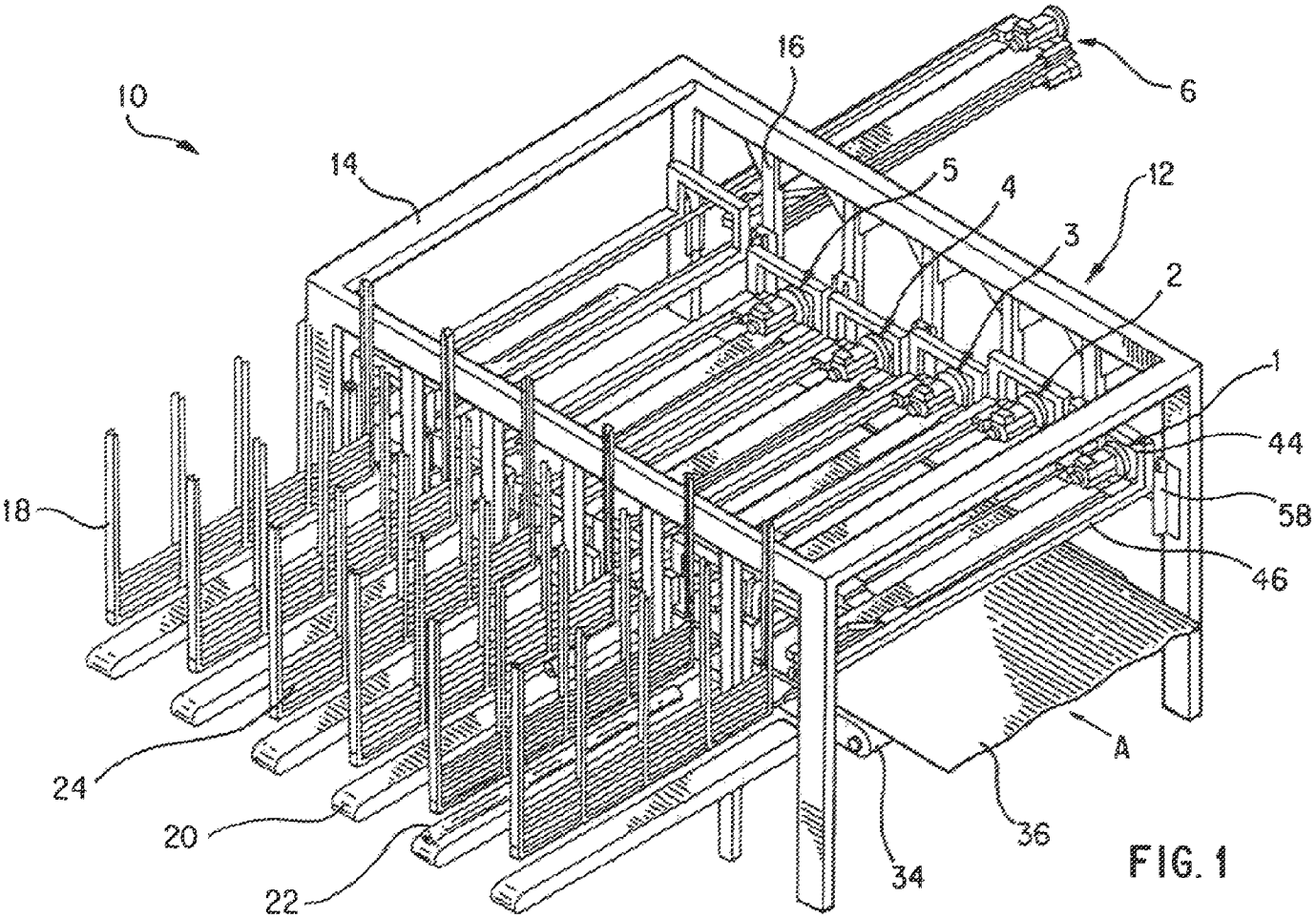
FIG. 1 is a perspective view of one exemplary embodiment of a winder. This winder includes a plurality of independent winding modules that are positioned in the web direction with respect to one another and substantially contained within a modular frame.

Repeat use of reference characters in the present specification and drawings is intended to represent the same or analogous features or elements of the present invention.

DETAILED DESCRIPTION

Reference will now be made in detail to exemplary embodiments of the invention, one or more examples of which are illustrated in the drawings. Each example is provided by way of explanation of the invention, and not meant as a limitation of the invention. For example, features illustrated or described as part of one exemplary embodiment can be used with another exemplary embodiment to yield still a third exemplary embodiment. It is intended that the present invention include these and other modifications and variations.

In general, the present disclosure is directed to a tail seal apparatus that is capable of applying an adhesive to a sheet material, such as a tissue web, as the web is being wound into a roll or log and as the winding cycle is near completion. Of particular advantage, the apparatus is capable of applying an adhesive to the web in-line. For instance, in one embodiment, the apparatus can be installed in a winding process during which a parent roll is unwound and formed into multiple, smaller spirally wound rolls. In one embodiment, the apparatus not only applies adhesive to a tail end of a web during the winding process, but also controls the tail end during the end of the winding cycle and provides an ironing mechanism after the adhesive has been applied. Not only is the apparatus relatively simple, but capable of sealing the tail end of a web to a wound roll with minimal issues regarding product contamination or the possibility of undesired web breaks.

The tail sealing apparatus of the present disclosure can be used in numerous and diverse winding processes. In one embodiment, for instance, the tail sealing apparatus may be incorporated into a turret winding system that relies on center winding. Alternatively, the tail sealing apparatus may be incorporated into a winding system that relies solely on surface winding. In yet another embodiment, the tail sealing apparatus may be incorporated into a winding system that includes a plurality of independent winding modules as shown in the attached figures. The winding modules may wind the web into a rolled product by center winding, surface winding, and combinations of center and surface winding. This allows for the production of rolled products with varying degrees of softness and hardness. The attached figures, however, are provided for purposes of explanation and show one particular winding environment in which the apparatus may be incorporated.

As described above, the winder may have a plurality of independent winding modules. Each individual winding module may wind the web such that if one or more modules are disabled, the remaining modules may continue to wind without interruption. This allows for operator servicing and routine maintenance or repairs of a module to be made without shutting down the winder. This configuration has particular advantages in that waste is eliminated and efficiency and speed of the production of the rolled product is improved.

A winding module 12 as described above is shown in FIG. 1 in order to wind a web 36 and form a rolled product 22. Although a plurality of independent winding modules 12 may be used to produce rolled products 22, the explanation of the functioning of only one winding module 12 is necessary in order to understand the building process of the rolled product 22.

Figure 5:
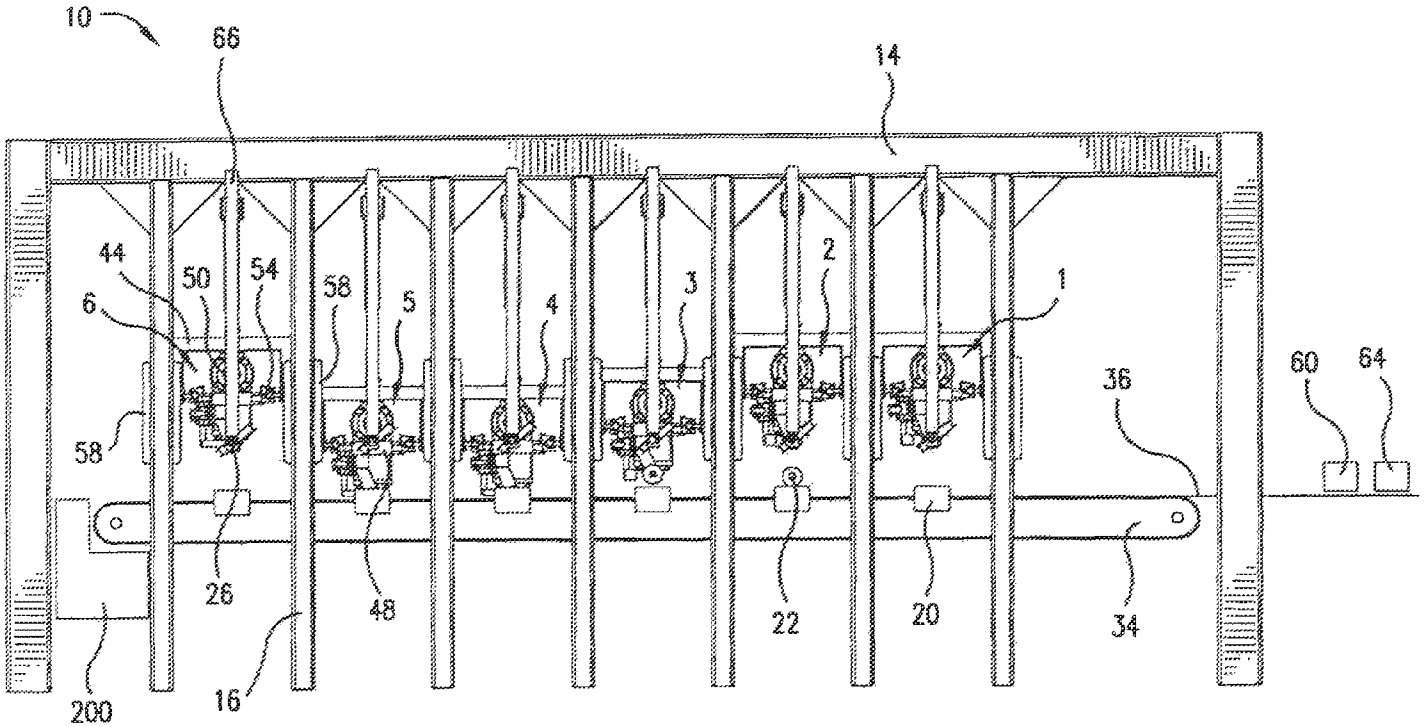
FIG. 5 is a side elevation view of an exemplary embodiment of a winder. The drawing shows winding modules in addition to other modules, which perform functions on a web.

Referring to FIG. 5, a web 36 is transported by a web transport apparatus 34 as shown. The web 36 is cut to a predetermined length by use of, for instance, a cut-off module 60.

Figure 10:
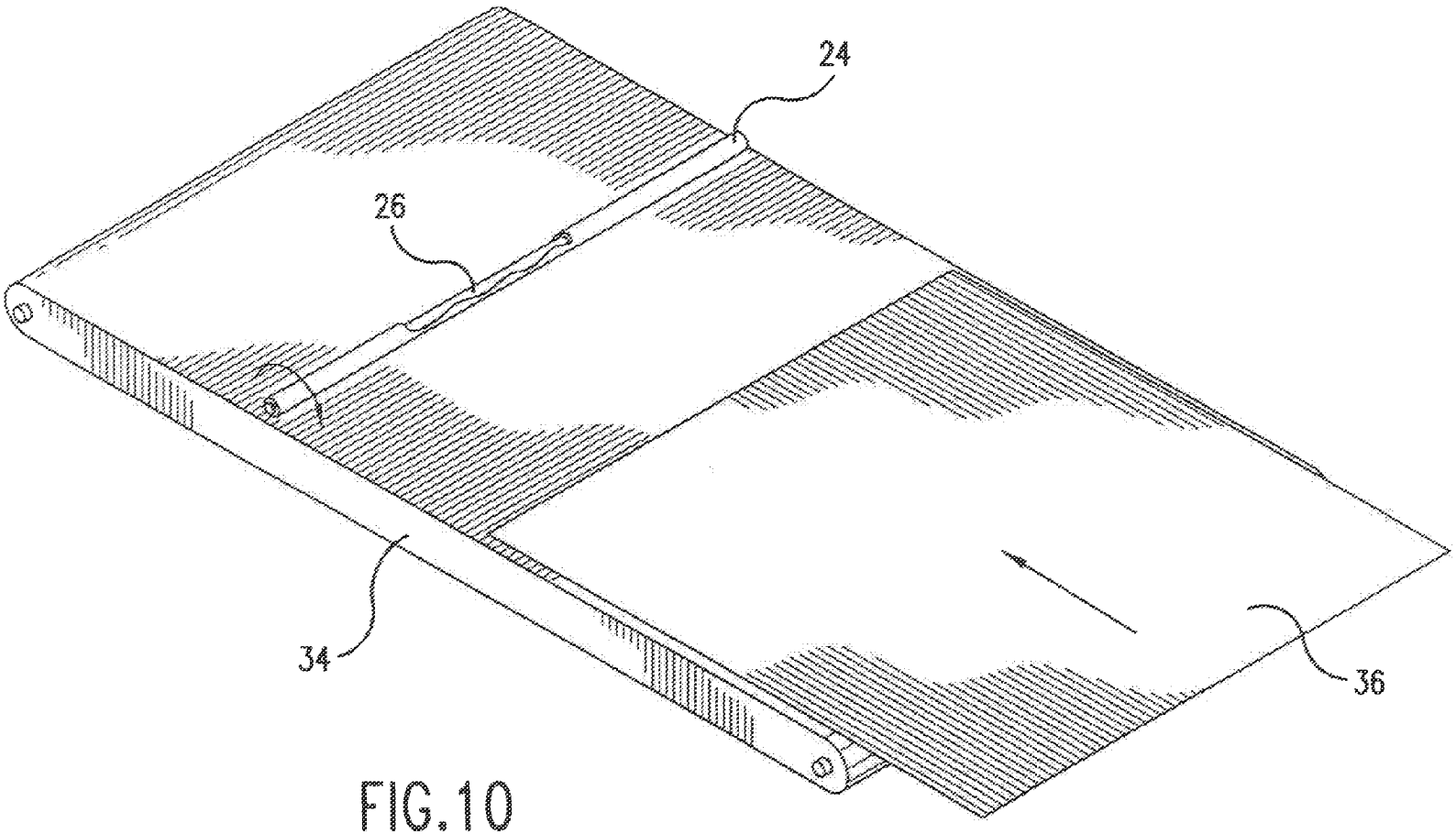
FIG. 10 is a perspective view of a web being transported by a web transport apparatus into proximity with a mandrel having a core.

Referring to FIG. 10, in one embodiment, the mandrel 26 is accelerated so that the speed of the mandrel 26 matches the speed of the web 36. Mandrel 26 has a core 24 located thereon. In other embodiments, however, the mandrel may not include a core for careless winding. The mandrel 26 is lowered into a ready to wind position and awaits the web 36. The core 24 is moved into contact with the leading edge of the web 36. The web 36 is then wound onto core 24 and is attached to core 24 by, for instance, an adhesive previously applied to the core 24.

Figure 11:
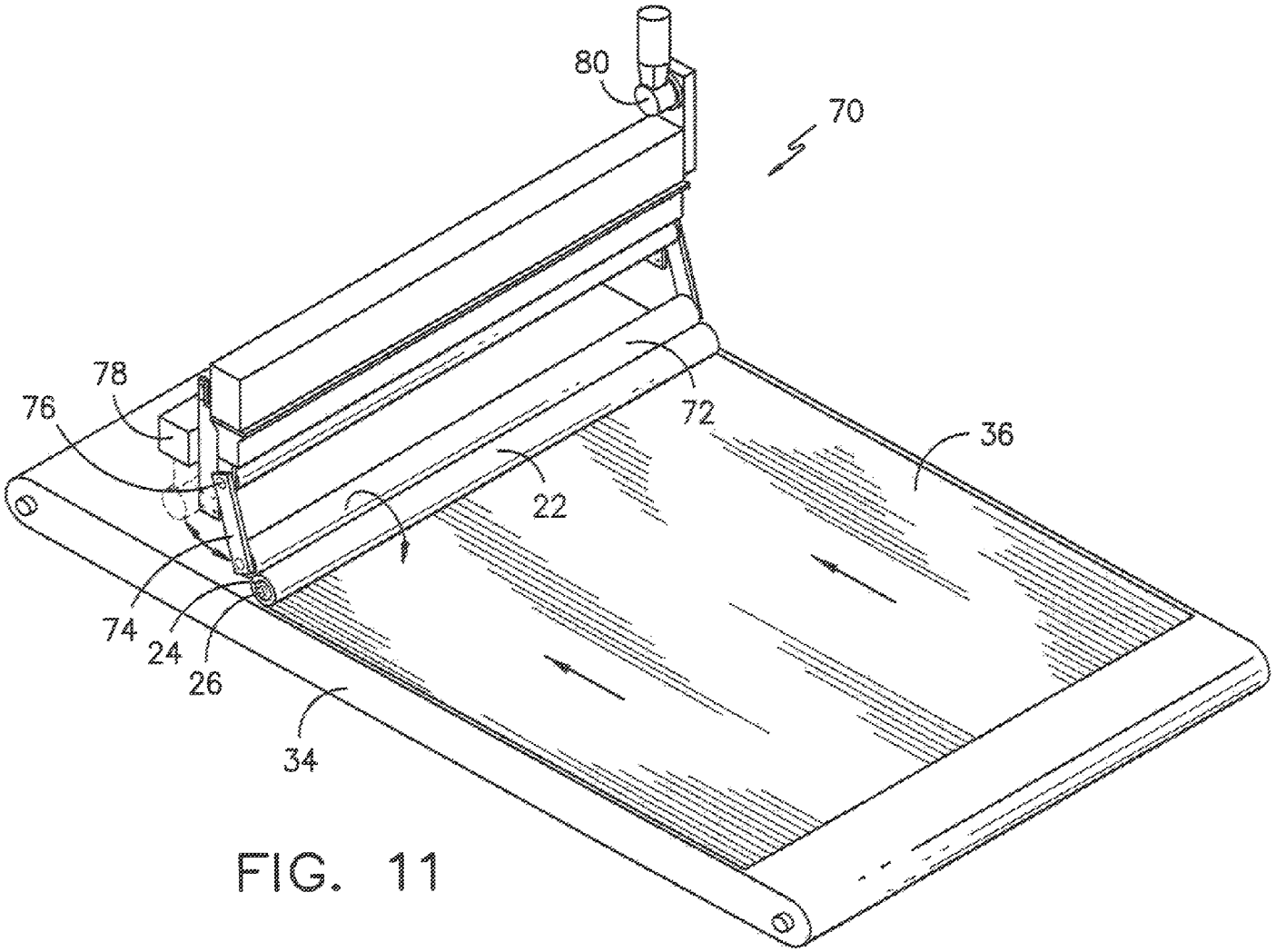
FIG. 11 is a perspective view of a rotating mandrel and core that are winding a web.

FIG. 11 shows the web 36 being wound onto the core 24. The winding of the web 36 onto core 24 may be controlled by the pressing of the core 24 onto the web transport apparatus 34 to form a nip. The magnitude with which the core 24 is pressed onto the web transport apparatus 34 creates a nip pressure that can control the winding of the web 36 onto the core 24. Additionally, the incoming tension of the web 36 can be controlled in order to effect the winding of the web 36 onto the core 24. Another control that is possible to wind the web 36 onto the core 24 involves the torque of the mandrel 26. Varying the torque on the mandrel 26 will cause a variance in the winding of the web 36 onto the core 24. All three of these types of winding controls, "nip, tension, and torque differential", can be employed. Also, the winding of the web 36 may be affected by using simply one or two of these controls.

The web 36 may be cut once the desired length of web 36 has been rolled onto the core 24. At this point, the leading edge of the next web 36 will be moved by the web transport apparatus 34 into contact with another winding module 12.

Referring to FIGS. 2, 8, 9 and 11, the winding system further includes a tail sealing apparatus 70 made in accordance with the present disclosure that includes an adhesive applicator device 72. In one embodiment, a tail sealing apparatus 70 in accordance with the present disclosure may be associated with each of the winding modules 12. It should also be appreciated that the tail sealing apparatus of the present disclosure may be used in other various different winding systems including turret winding systems. The winding system illustrated in the figures is for exemplary purposes only.

The tail sealing apparatus 70 of the present disclosure is configured to apply an adhesive to the trailing edge of the web at a location so that the adhesive is placed in between the roll being formed and the outermost layer of the web. The adhesive therefore prevents the spirally wound rolls from unraveling during further processing and packaging of the roils. As shown in the figures, the tail sealing apparatus of the present disclosure can be incorporated directly in-line and apply adhesive while the rolls are being formed. In particular, the adhesive can be applied in order to seal the tail of the rolled product 22 before being unloaded to the rolled product transport apparatus 20.

Figure 8:
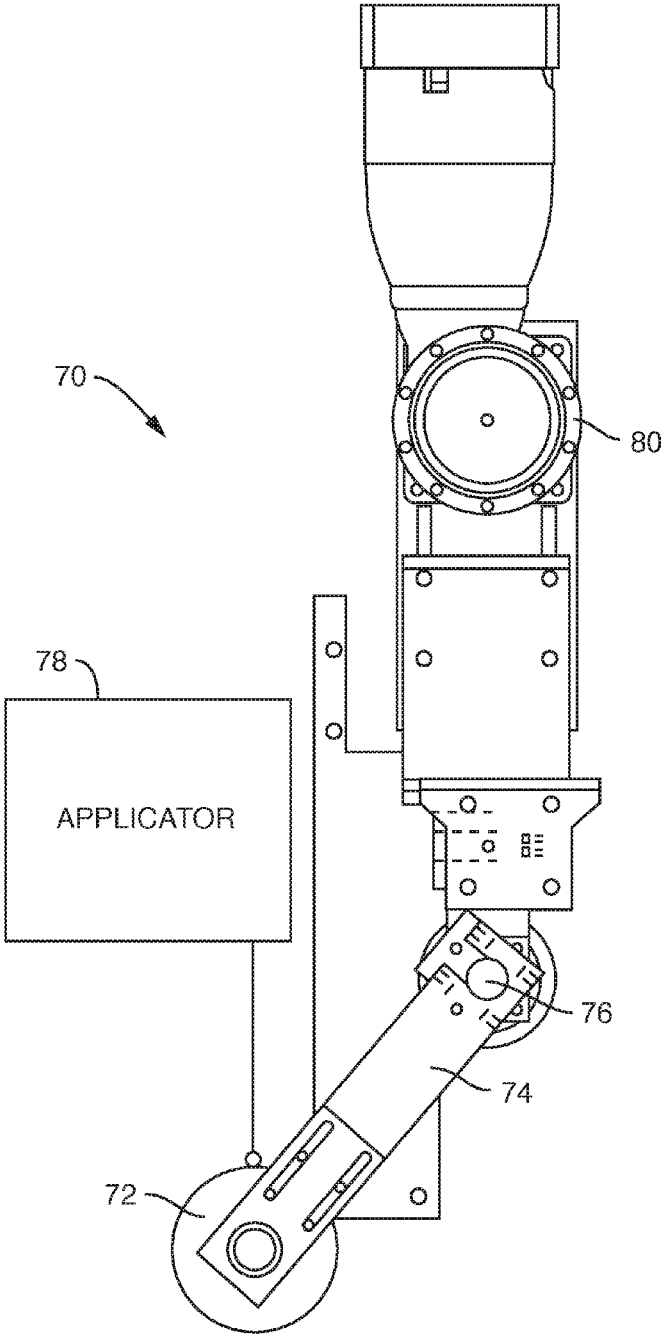
FIG. 8 is a side view of one embodiment of an apparatus for applying an adhesive to a web while it is being wound.
Figure 9:
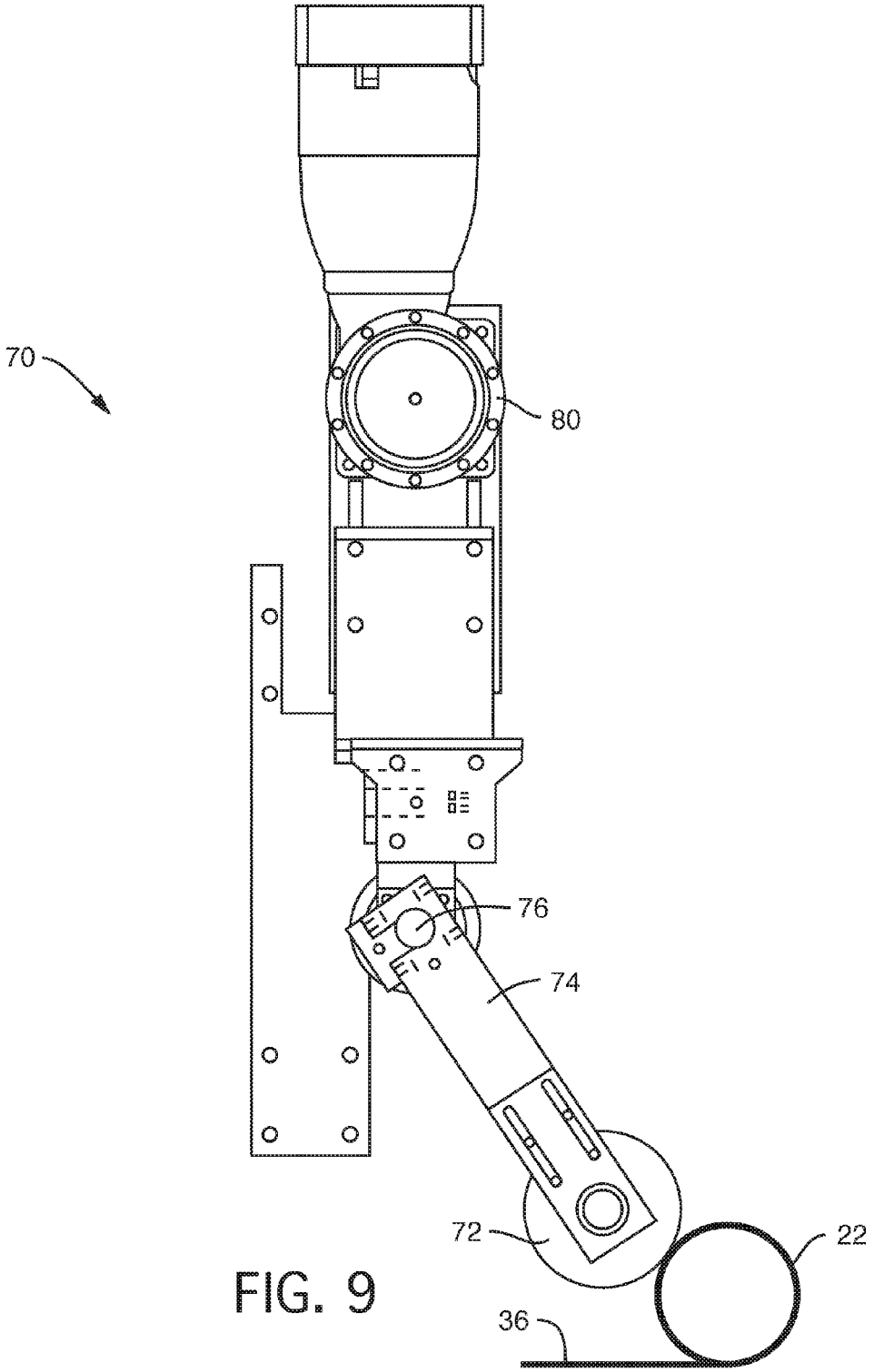
FIG. 9 is a side view of the apparatus shown in FIG. 8.

Referring to FIGS. 8 and 9, the tail sealing apparatus 70 made in accordance with the present disclosure is shown in greater detail. As shown in FIG. 8, the tail sealing apparatus 70 includes an applicator device 72 that is attached to an arm 74. In one embodiment, the arm 74 can be configured to move the applicator device 72 from a non-engagement position to an engagement position. For example, the non-engagement position is shown in FIG. 8, while the engagement position is shown in FIG. 9. In FIG. 9, the arm 74 has pivoted about a pivot point 76 so that the applicator device 72 contacts a roll 22 formed from the web 36. As will be described in detail below, the applicator device 72 contacts the roll 22 near the end of the winding process in order to apply an adhesive to the web for adhering a trailing edge of the web to the exterior surface of the roll.

The arm 74 may move between the non-engagement position and the engagement position by any suitable motor or hydraulic or pneumatic cylinder. In the embodiment illustrated, the arm pivots about the pivot point for moving the applicator device 70. In other embodiments, however, any suitable manner of moving the applicator device is within the scope of the present disclosure. For instance, in other embodiments, the applicator device may move along a linear track by a chain or belt.

As shown in FIG. 8, the applicator device 72 is in communication with an adhesive applicator 78. The adhesive applicator is designed to apply an adhesive to a surface of the applicator device 72 when the applicator device is in the non-engagement position. The adhesive applicator 78 may comprise any suitable device capable of properly positioning an adhesive on the surface of the applicator device. In one embodiment, for instance, the adhesive applicator may comprise an extruder that extrudes a bead of adhesive onto the surface of the applicator device 72. In other embodiments, however, the applicator device 78 may comprise a sprayer that sprays adhesive onto the applicator device. In still another embodiment, the adhesive applicator may comprise a rotating roll to which an adhesive is applied and then brought into contact with the applicator device 72.

The adhesive that is applied to the applicator device may comprise any adhesive conventionally used to adhere the tail end of a web to a roll, such as a tissue roll. For instance, the adhesive may comprise a starch adhesive. In one embodiment, the adhesive may comprise water. Applying water to a tissue web, for instance, may activate hydrogen bonding causing separate layers to adhere together. In other embodiments, however, an adhesive may be used that mechanically bonds the layers together.

As shown in FIGS. 8, 9 and 11, adhesive is applied to the applicator device 72 by the adhesive applicator 78. In one embodiment, the adhesive is applied to the adhesive applicator 72 while in the non-engagement position. After the adhesive is applied, the applicator device 72 is moved into the engagement position as shown in FIGS. 9 and 11 for contacting a roll being formed. Adhesive applied to a surface of the applicator device is then transferred to the web 36 at a time when the winding cycle is almost completed. In this manner, adhesive is applied to the rolled product 22 only between the outer two layers of the roll. In one embodiment, after the adhesive has been applied to the roll, the applicator device 72 maintains contact with the roll 22 as the roll 22 continues to spin. In this manner, the applicator device 72 can have an ironing effect on the exterior surface of the roll for minimizing and eliminating any irregularities in the outside surface of the roll. In this manner, a rolled product 22 is formed that has a smooth exterior surface. The smooth exterior surface prevents the roll from being damaged during further processing, during movement, and during packaging. In addition, the rolled product 22 has an enhanced aesthetic appearance, making the roll more desirable to consumers.

The applicator device 72 can be any suitable device capable of transferring an adhesive to a surface of a moving roll. In the embodiments illustrated in FIGS. 8 and 9, the applicator device 72 has a moving surface that can move at the same speed as the surface of the spirally wound roll 22.

In one particular embodiment, for instance, the applicator device 72 may comprise a rotatable roll. The rotatable roll may be an idle roll that rotates when contacting the roll 22 being wound. In an alternative embodiment, however, the applicator device 72 may be in operative association with a motor 80 for rotating the applicator device.

In one embodiment, the applicator device 72 is rotated in a direction opposite to the roll 22 being formed. For example, the roll 22 may be wound in a counterclockwise rotation, while the applicator device 72 may be rotated in a clockwise direction.

The motor 80 may comprise any suitable motor or device capable of rotating the applicator device 72. The motor 80 can be coupled to the applicator device 72 using any suitable linking system, such as belts, chains and/or gears.

In one embodiment, the motor 80 may be configured to rotate the applicator device 72 prior to contact with the roll 22 being formed. In particular, the applicator device can be rotated at a speed that substantially matches the speed of the roll 22 prior to contact. In this manner, a smooth contact occurs between the applicator device 72 and the roll 22 for preventing and minimizing web breaks or other process irregularities.

In one embodiment, a controller, such as a microprocessor or other similar device, may be used to control the tail sealing apparatus 70 and the adhesive applicator 78 for sealing the end of a wound roll. In fact, in one embodiment, a controller can be used to control the entire winding system including the tail sealing apparatus and the adhesive applicator.

In one particular embodiment, the sequence of events for applying adhesive to a web being wound into a roll using the tail sealing apparatus includes first applying adhesive to the surface of the applicator device 72 while the applicator device is resting in the non-engagement position. For example, the adhesive applicator 78 may extrude a bead of adhesive across the surface of the applicator device 72. The add-on rate of the adhesive and the applicator device start/stop positions may be adjusted during the application of the adhesive to the surface. Once adhesive is applied to the surface of the applicator device 72, the adhesive applicator 78 may move away from the surface of the applicator device 72 if necessary. In one embodiment, for instance, the adhesive applicator 78 may pivot between an adhesive application position and a non-engagement position with the applicator device 72.

In conjunction with the application of adhesive to the surface of the applicator device 72, a winding module may be winding a web from a parent roll to form a spirally wound product roll. As the wound roll is near completion, a controller may move the applicator device 72 from the non-engagement position to the engagement position. The rate of movement of the applicator device 72 may be consistent or variable and there may or may not be dwell positions along the movement path.

In one embodiment, the web of material is then cut to produce a trailing end. When the roll has about one wrap of the web yet to wind, the applicator device 72 contacts the web or the rotating roll such that the adhesive bead transfers to the web. More particularly, the adhesive is transferred to the web such that the adhesive is located in between the two most outermost layers of the roll being wound. Adjustment of the distance of the web yet unwound relative to the contact point of the applicator device 72 determines the amount of tail that is sealed to the roll being formed.

After the adhesive is transferred to the web, in one embodiment, the applicator device 72 stays in contact with the rotating roll through the completion of the wind and through a deceleration phase. By maintaining contact, the applicator device 72 provides both control of the tail during the completion of the winding sequence and provides ironing pressure to help the adhesive bond the outer two most layers of the web together. During final contact, all residual adhesive may be transferred to the outer layer of the web which may clean the surface of the applicator device 72. Once the rotating roll has decelerated, the applicator device 72 may move back into the non-engagement position. The completed rolled product can then be stripped from the mandrel.

Figure 12:
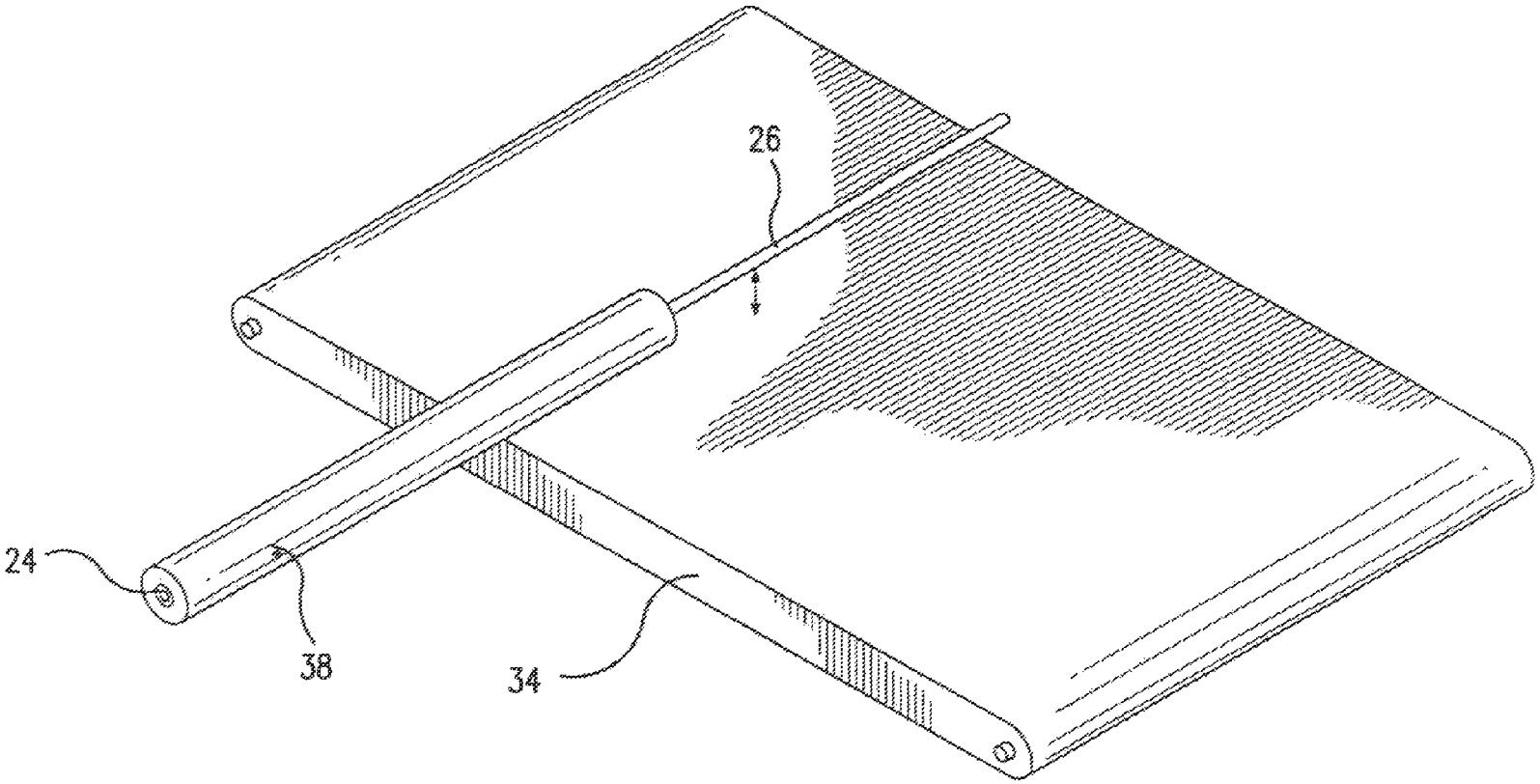
FIG. 12 is a perspective view of a rolled product with a core that is shown being stripped from a mandrel.

For instance, FIG. 12 shows the mandrel 26 being moved from a location immediately adjacent to the web transport apparatus 34 in FIG. 10 to a position slightly above the web transport apparatus 34. The wound length of web 36 is shown in FIG. 12 as being a rolled product 38 with a core 24. Now, a stripping function is carried out that moves the rolled product 38 with a core 24 off of the mandrel 26. This mechanism is shown as a product stripping apparatus 28 in FIG. 2. The rolled product 38 with a core 24 is moved onto a rolled product transport apparatus 20 as shown in FIGS. 1 and 2.

Figure 13:
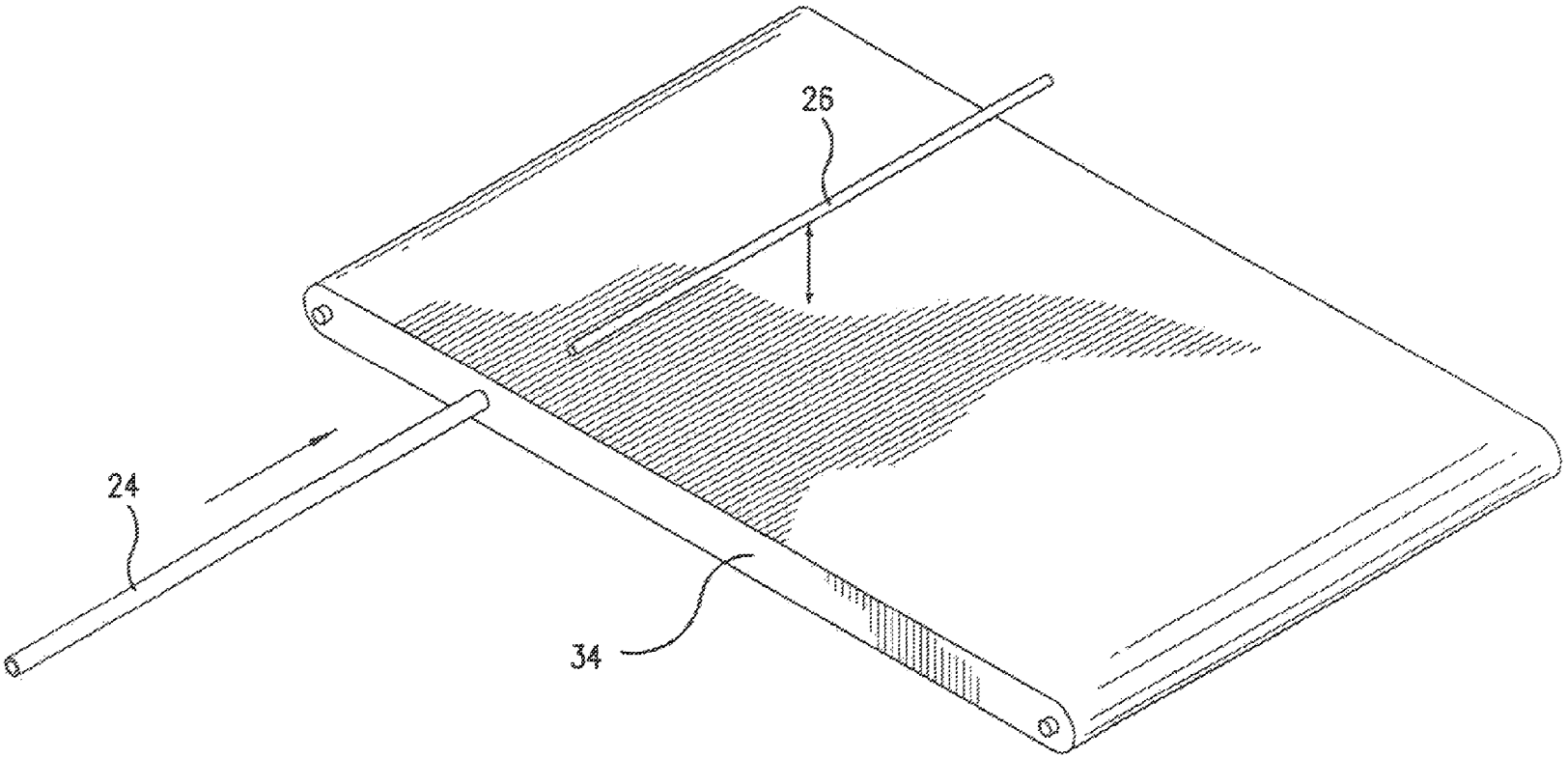
FIG. 13 is a perspective view of a mandrel that is in position to load a core.

Once the rolled product 38 with a core 24 is stripped from the mandrel 26, the mandrel 26 is moved into a core loading position as shown in FIG. 13. The product stripping apparatus 28 is shown in more detail in FIG. 2. Once the product stripping apparatus 28 finishes stripping the rolled product 38 with a core 24, the product stripping apparatus 28 is located at the end of the mandrel 26. This location acts to stabilize the mandrel 26 and prevent it from moving due to the cantilevered configuration of mandrel 26. In addition, the product stripping apparatus 28 helps to properly locate the end point of mandrel 26 for the loading of a core 24.

Figure 14:
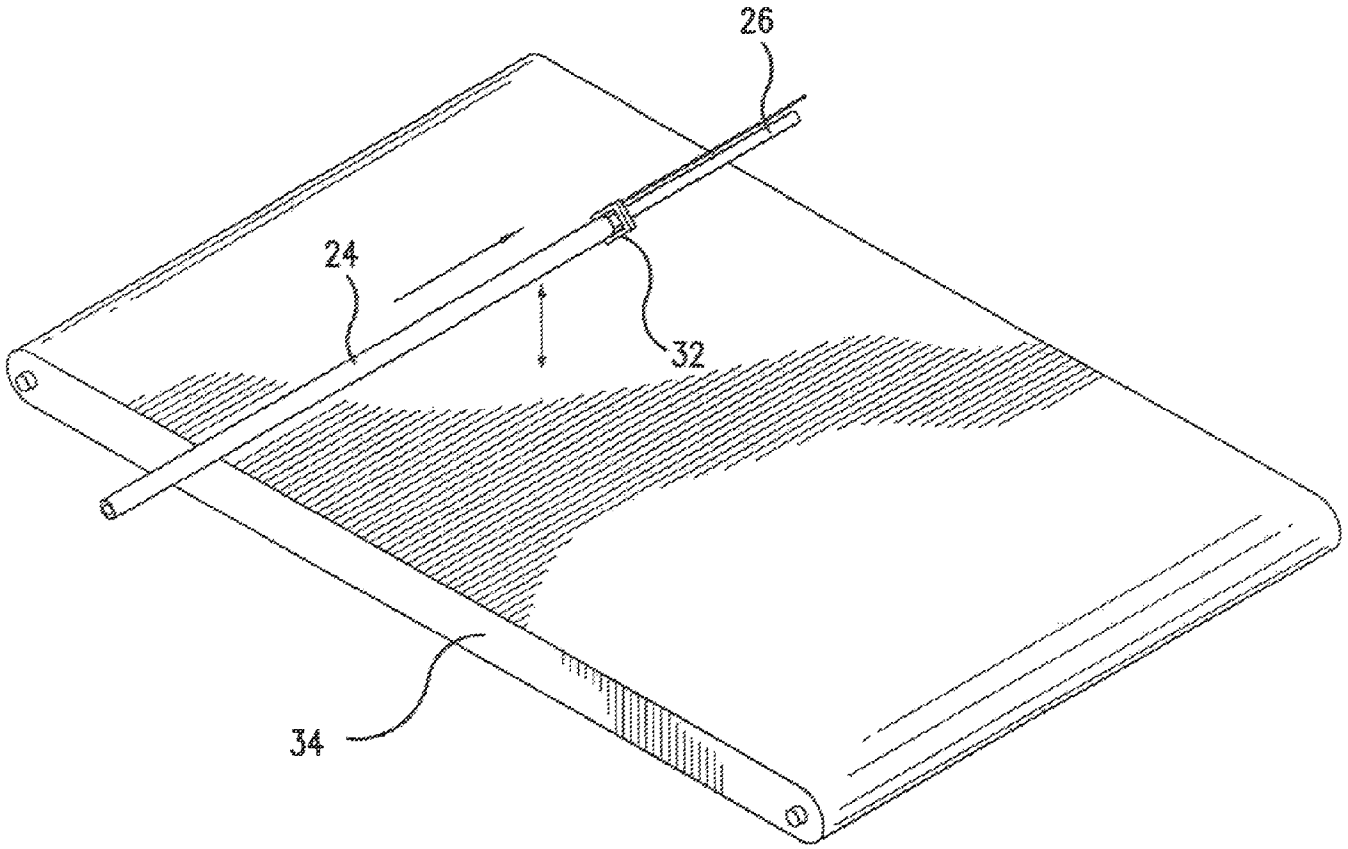
FIG. 14 is a perspective view that shows a core being loaded onto a mandrel via a core loading apparatus.

FIG. 14 shows one embodiment of a core 24 being loaded onto the mandrel 26. The loading of the core 24 is affected by a core loading apparatus 32. The product stripping apparatus may also serve as a core loading apparatus. The core loading apparatus 32 may be simply a frictional engagement between the core loading apparatus 32 and the core 24. However, the core loading apparatus 32 can be configured in other ways known in the art. In one embodiment of the present invention, once the core 24 is loaded, a cupping arm 70 (shown in FIG. 6) closes. Upon loading of the core 24 onto the mandrel 26, the mandrel 26 is moved into the ready to wind position as shown in FIG. 10. The cores 24 are located in a core supplying apparatus 18 as shown in FIGS. 1, 2, 3, and 4.

Figure 2:
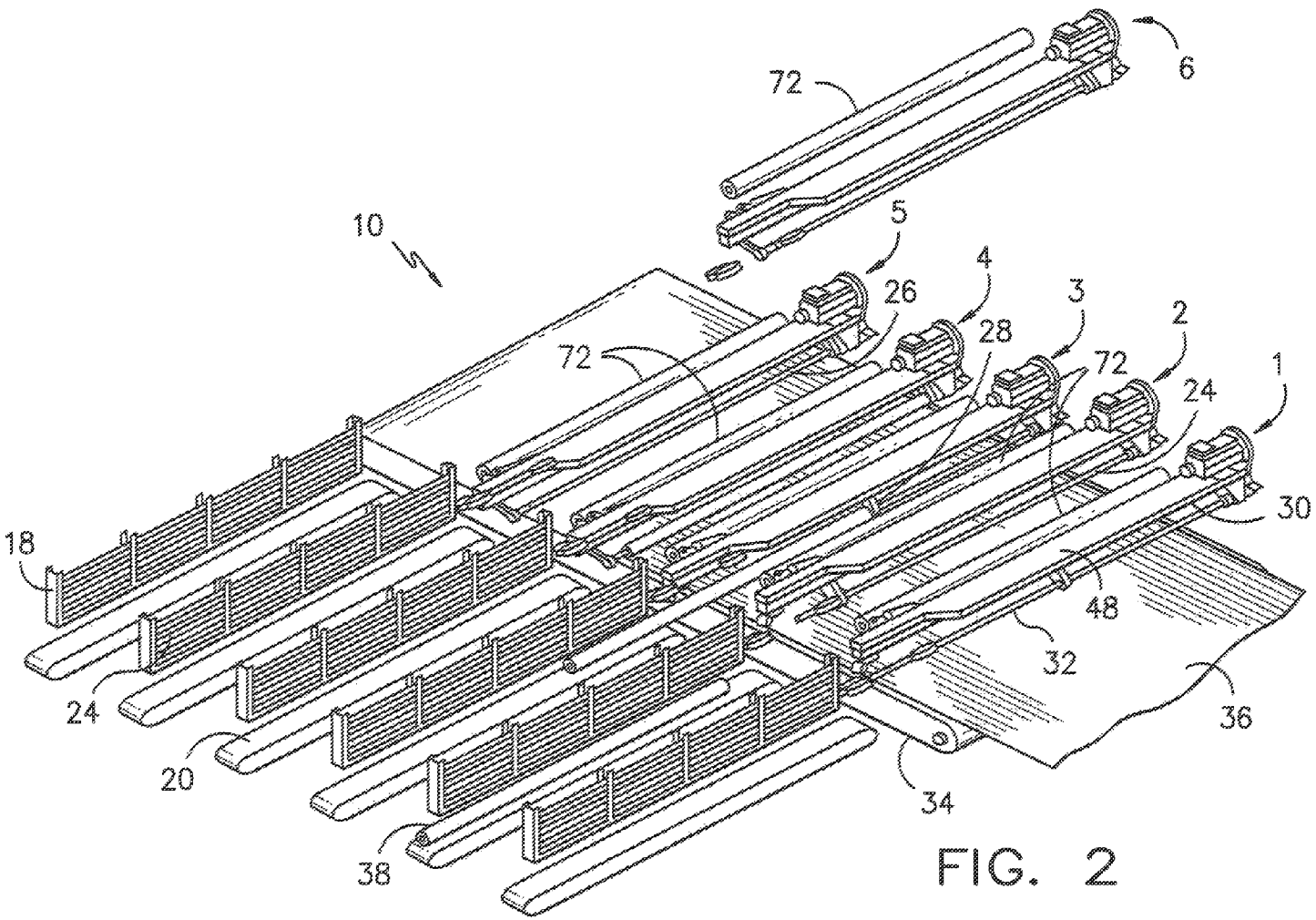
FIG. 2 is a perspective view of an exemplary embodiment of a winder. This drawing shows a plurality of independent winding modules, which are performing the various functions of a log winding cycle.

FIG. 1 shows an exemplary embodiment of a winder according to the invention as a "rewinder" 10 with a plurality of independent winding modules 12 arranged in a linear fashion with respect to one another. A frame 14 supports the plurality of independent winding modules 12. A web transport apparatus 34 is present which transports the web 36 for eventual contact with the plurality of independent winding modules 12. The frame 14 is composed of a plurality of posts 16 onto which the plurality of independent winding modules 12 are slidably engaged and supported. The frame 14 may also be comprised of modular frame sections that would engage each other to form a rigid structure. The number of modular frame sections would coincide with number of winding modules utilized.

Situated adjacent to the frame 14 are a series of core supplying apparatuses 18. A plurality of cores 24 may be included within each core supplying apparatus 18. These cores 24 may be used by the plurality of independent winding modules 12 to form rolled products 22. Once formed, the rolled products 22 may be removed from the plurality of independent winding modules 12 and placed onto a rolled product transport apparatus 20. The rolled product transport apparatus 20 is located proximate to the frame 14 and web transport apparatus 34.

FIG. 2 shows a rewinder 10 as substantially disclosed in FIG. 1 but having the frame 14 and other parts removed for clarity. In this exemplary embodiment, the plurality of independent winding modules 12 are composed of six winding modules 1-6. However, it is to be understood that the system can have any number of independent winding modules 12 being other than six in number. For instance, only one winding module 12 may be used in one exemplary embodiment. In alternative embodiments, the winding system may include five winding modules. In other embodiments, the winding system may include up to 18 winding modules.

Each winding module 1-6 is shown performing a different function. Winding module 1 is shown in the process of loading a core 24 thereon. The plurality of independent winding modules 12 are provided with a core loading apparatus for placing a core 24 onto a mandrel 26 of the plurality of independent winding modules 12. Any number of variations of a core loading apparatus may be utilized. For instance, the core loading apparatus may be a combination of a rod that extends into the core supplying apparatus 18 and pushes a core 24 partially onto the mandrel 26 and a mechanism attached to the linear actuator of the product stripping apparatus 28 that frictionally engages and pulls the core 24 the remaining distance onto the mandrel 26. As shown in FIG. 2, winding module 1 is in the process of pulling a core 24 from the core supplying apparatus 18 and placing the core 24 on mandrel 26.

Winding module 2 is shown as having removed the rolled product 22 from its mandrel 26. The rolled product 22 is placed onto a rolled product transport apparatus 20. In this case, the rolled product 22 is a rolled product with a core 38. Such a rolled product with a core 38 is a rolled product 22 that is formed by having the web 36 being spirally wrapped around a core 24. It is to be understood that the rolled product 22 may also be a rolled product that does not have a core 24 and instead is simply a solid roll of wound web 36. It may also be the case that the rolled product 22 formed does not include a core 24, but has a cavity in the center of the rolled product 22. Various configurations of rolled product 22 may thus be formed in accordance with the present disclosure.

Each of the plurality of independent winding modules 12 is provided with a product stripping apparatus 28 that is used to remove the rolled product 22 from the winding modules 1-6. Winding module 3 is shown as being in the process of stripping a rolled product 22 from the winding module 3. The product stripping apparatus 28 is shown as being a flange which stabilizes the mandrel 26 and contacts an end of the rolled product 22 and pushes the rolled product 22 off of the mandrel 26. Also, the product stripping apparatus 28 helps locate the end of the mandrel 26 in the proper position for the loading of a core 24. The rolled product stripping apparatus 28 therefore is a mechanical apparatus that moves in the direction of the rolled product transport apparatus 20. The product stripping apparatus 28 may be configured differently in other exemplary embodiments of the invention.

The winding module 4 is shown as being in the process of winding the web 36 in order to form the rolled product 22. This winding process may be center winding, surface winding, or a combination of center and surface winding.

Winding module 5 is shown in a position where it is ready to wind the web 36 once the winding module 4 finishes winding the web 36 to produce a rolled product 22. In other words, winding module 5 is in a "ready to wind" position.

Winding module 6 is shown in FIG. 1 in a "racked out" position. It may be the case that winding module 6 has either faulted or is in need of routine maintenance and is therefore moved substantially out of frame 14 for access by maintenance or operations personnel. As such, winding module 6 is not in a position to wind the web 36 to produce rolled product 22, but the other five winding modules 1-5 are still able to function without interruption to produce the rolled product 22. By acting as individual winders, the plurality of independent winding modules 12 allow for uninterrupted production even when one or more of the winding modules becomes disabled.

Figure 4:
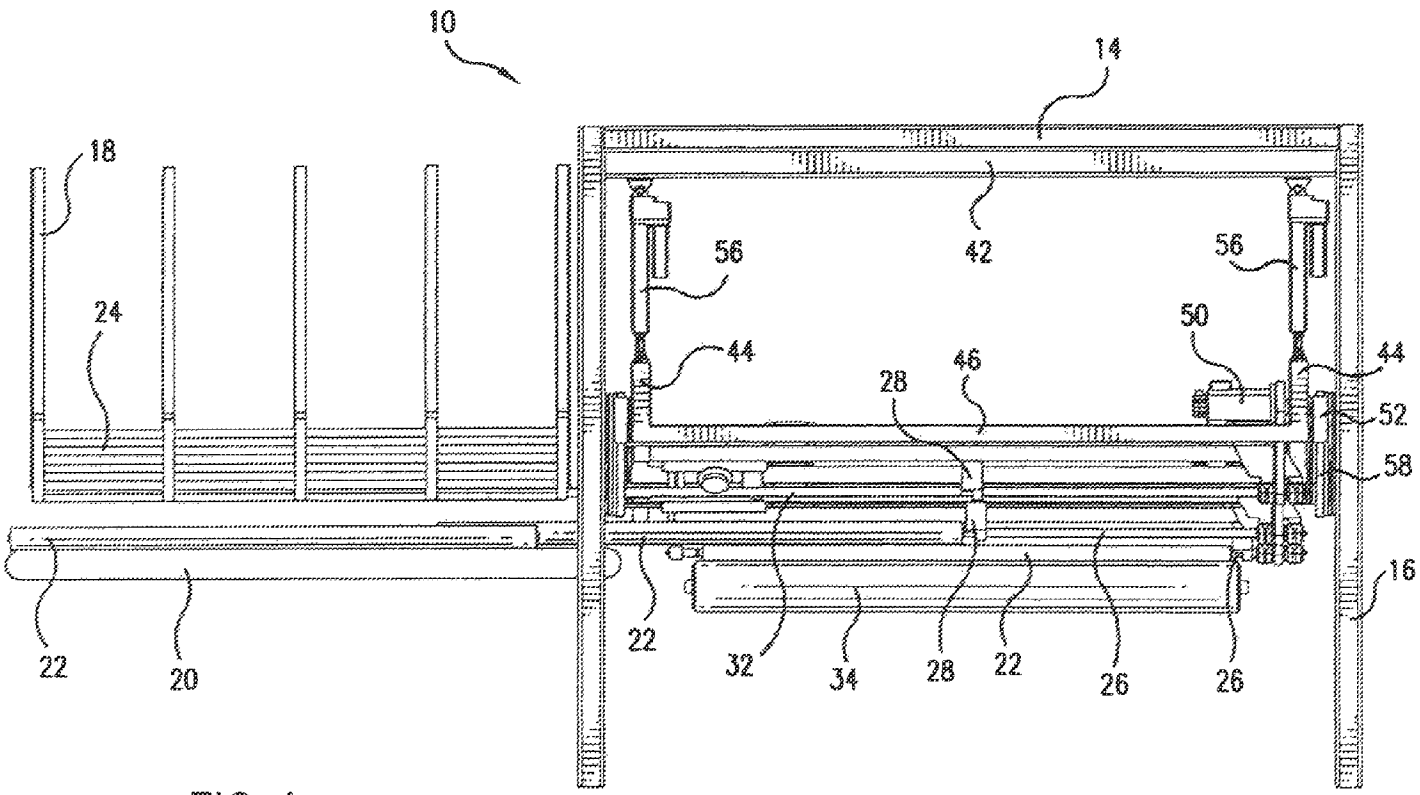
FIG. 4 is a front elevation view of an exemplary embodiment of a winder. The drawing shows a plurality of independent winding modules linearly situated with respect to one another and performing the various functions of a log winding cycle.

Each winding module 12 may have a positioning apparatus 56 (FIG. 4). The positioning apparatus 56 moves the winding module perpendicularly with respect to web transport apparatus 34, and in and out of engagement with web 36. Although the modules 12 are shown as being moved in a substantially vertical direction, other exemplary embodiments of the invention may have the modules 12 moved horizontally or even rotated into position with respect to web 36. Other ways of positioning the modules 12 can be envisioned.

Therefore, each of the plurality of independent winding modules 12 may be a self-contained unit and may perform the functions as described with respect to the winding modules 1-6. Winding module 1 may load a core 24 onto the mandrel 26 if a core 24 is desired for the particular rolled product 22 being produced. Next, the winding module 1 may be linearly positioned so as to be in a "ready to wind" position. Further, the mandrel 26 may be rotated to a desired rotational speed and then positioned by the positioning apparatus 56 in order to initiate contact with the web 36. The rotational speed of the mandrel 26 and the position of the winding module 1 with respect to the web 36 may be controlled during the building of the rolled product 22. After completion of the wind, the position of the module 1 with respect to the web 36 will be varied so that the winding module 1 is in a position to effect removal of the rolled product 22. The rolled product 22 may be removed by the product stripping apparatus 28 such that the rolled product 22 is placed on the rolled product transport apparatus 20. Finally, the winding module 1 may be positioned such that it is capable of loading a core 24 onto the mandrel 26 if so desired. Again, if a coreless rolled product were to be produced as the rolled product 22, the step of loading a core 24 would be skipped. It is to be understood that other exemplary embodiments of the present invention may have the core 24 loading operation and the core 24 stripping operation occur in the same or different positions with regard to the mandrel 26.

The rewinder 10 may form rolled products 22 that have varying characteristics by changing the type of winding process being utilized. The driven mandrel 26 allows for center winding of the web 36 in order to produce a low density, softer rolled product 22. The positioning apparatus 56 in combination with the web transport apparatus 34 allow for surface winding of the web 36 and the production of a high density, harder wound rolled product 22. Surface winding is induced by the contact between the core 24 and the web 36 to form a nip 68 (shown in FIG. 6) between the core 24 and the web transport apparatus 34. Once started, the nip 68 will be formed between the rolled product 22 as it is built and the web transport apparatus 34. As can be seen, the rewinder 10 therefore allows for both center winding and surface winding in order to produce rolled products 22. In addition, a combination of center winding and surface winding may be utilized in order to produce a rolled product 22 having varying characteristics. For instance, winding of the web 36 may be affected in part by rotation of the mandrel 26 (center winding) and in part by nip pressure applied by the positioning apparatus 56 onto the web 36 (surface winding). Therefore, the rewinder 10 may include an exemplary embodiment that allows for center winding, surface winding, and any combination in between. Additionally, as an option to using a motor to control the mandrel speed/torque a braking device (not shown) on the winding modules 12 may be present in order to further control the surface and center winding procedures.

The plurality of independent winding modules 12 may be adjusted in order to accommodate for the building of the rolled product 22. For instance, if surface winding were desired, the pressure between the rolled product 22 as it is being built and the web transport apparatus 34 may be adjusted by the use of the positioning apparatus 56 during the building of the rolled product 22.

Utilizing a plurality of independent winding modules 12 allows for a rewinder 10 that is capable of simultaneously producing rolled product 22 having varying attributes. For instance, the rolled products 22 that are produced may be made such that they have different sheet counts. Also, the rewinder 10 can be run at both high and low cycle rates with the modules 12 being set up in the most efficient manner for the rolled product 22 being built. The winding modules 12 may have winding controls specific to each module 12, with a common machine control. Real time changes may be made where different types of rolled products 22 are produced without having to significantly modify or stop the rewinder 10. Real time roll attributes can be measured and controlled.

Figure 3:
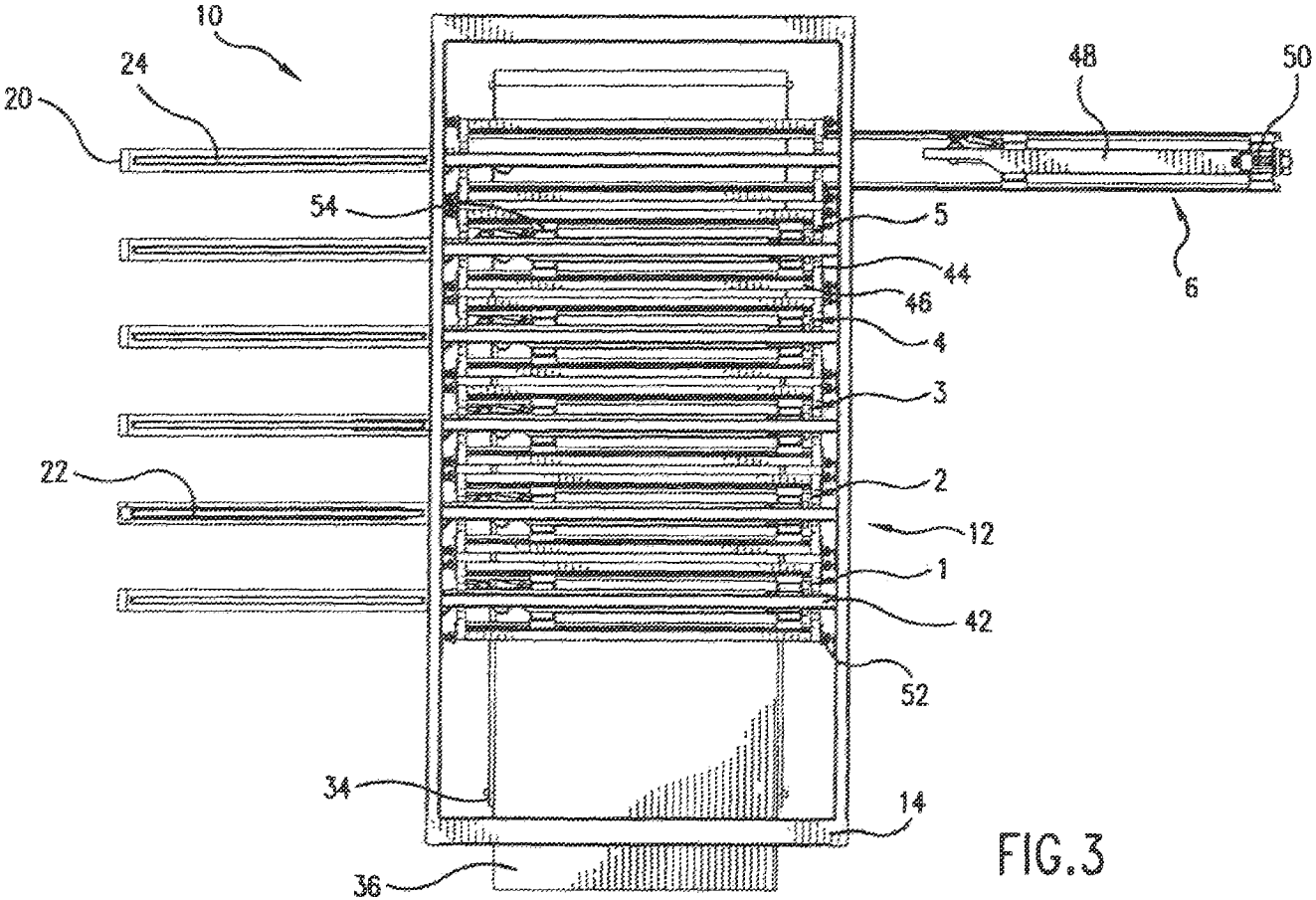
FIG. 3 is a plan view of an exemplary embodiment of a winder. The drawing shows a plurality of independent winding modules linearly situated with respect to one another and performing the various functions of a log winding cycle.

FIG. 3 shows a rewinder 10 having a frame 14 disposed about a plurality of independent winding modules 12. The frame 14 has a plurality of cross members 42 transversing the ends of the frame 14. The positioning apparatus 56 that communicates with the winding modules 1-6 is engaged on one end to the cross members 42, as shown in FIG. 4. A vertical linear support member 44 is present on the plurality of independent winding modules 12 in order to provide an attachment mechanism for the positioning apparatus 56 and to provide for stability of the winding modules. The positioning apparatus 56 may be a driven roller screw actuator. However, other means of positioning the plurality of independent winding modules 12 may be utilized. The vertical support members 44 also may engage a vertical linear slide support 58 that is attached to posts 16 on frame 14. Such a connection may be of various configurations, for instance a linear bearing or a sliding rail connection. Such a connection is shown as a vertical linear slide 52 that rides within the vertical linear slide support 58 in FIG. 4.

Figure 6:
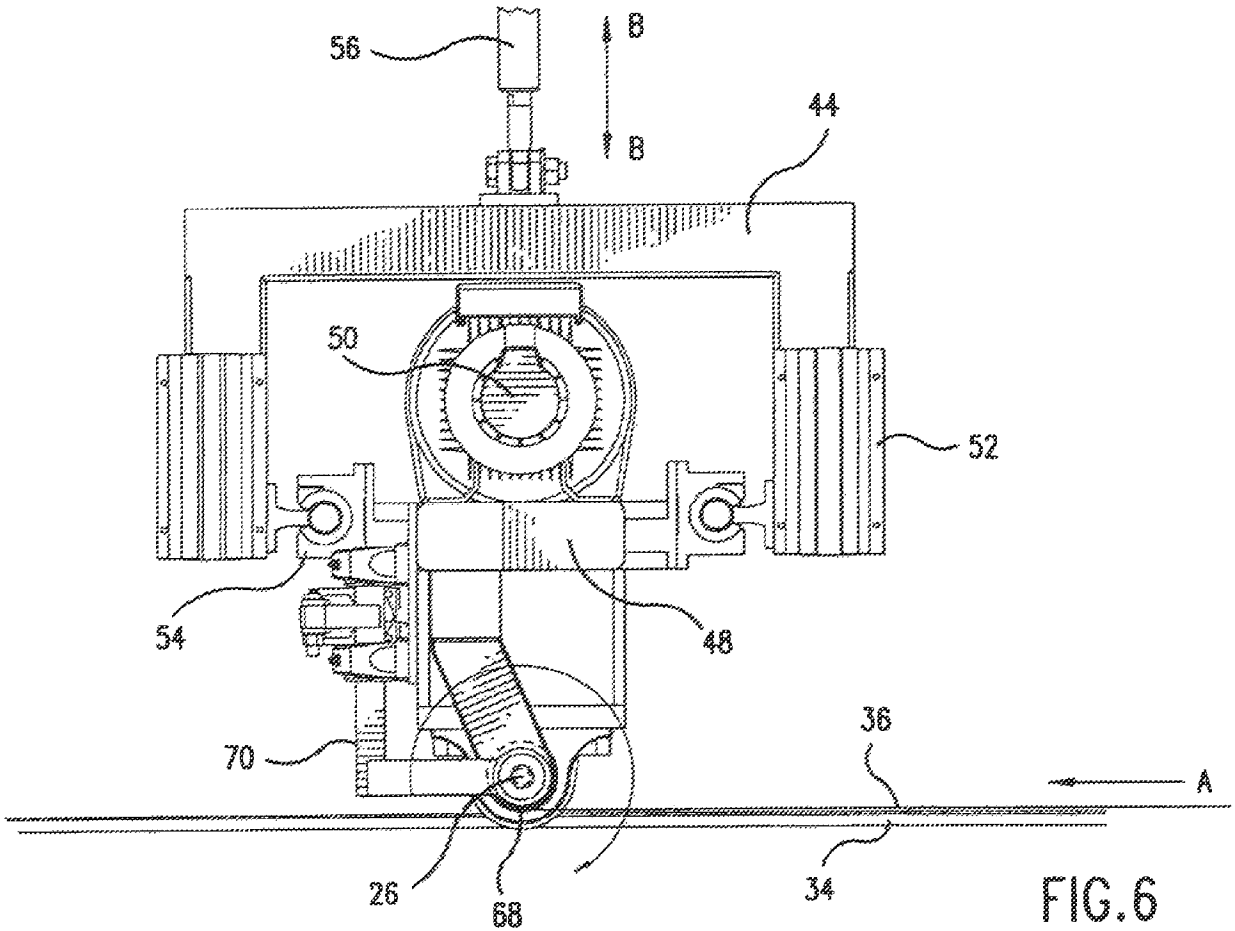
FIG. 6 is a side elevation view of an exemplary embodiment of an independent winding module. The drawing shows the winding module engaging a web and forming a rolled product.

A horizontal linear support member 46 is also present in the plurality of independent winding modules 12. The horizontal linear support member 46 may communicate with a horizontal linear slide 54 (as shown in FIG. 6) to allow some or all of the plurality of independent winding modules 12 to be moved outside of the frame 14. The horizontal linear slide 54 may be a linear rail type connection. However, various configurations may be possible.

FIG. 6 shows a close up view of an exemplary embodiment of a winding module. A servomotor 50 can be supported by the module frame 48 onto which a mandrel cupping arm 70 is configured. The mandrel cupping arm 70 is used to engage and support the end of the mandrel 26 opposite the drive during winding. As can be seen, the positioning apparatus 56 may move the winding module for engagement onto the web 36 as the web 36 is transported by the web transport apparatus 34. Doing so will produce a nip 68 at the point of contact between the mandrel 26 and the transport apparatus 34, with the web 36 thereafter being wound onto the mandrel 26 to produce a rolled product 22.

Figure 7:
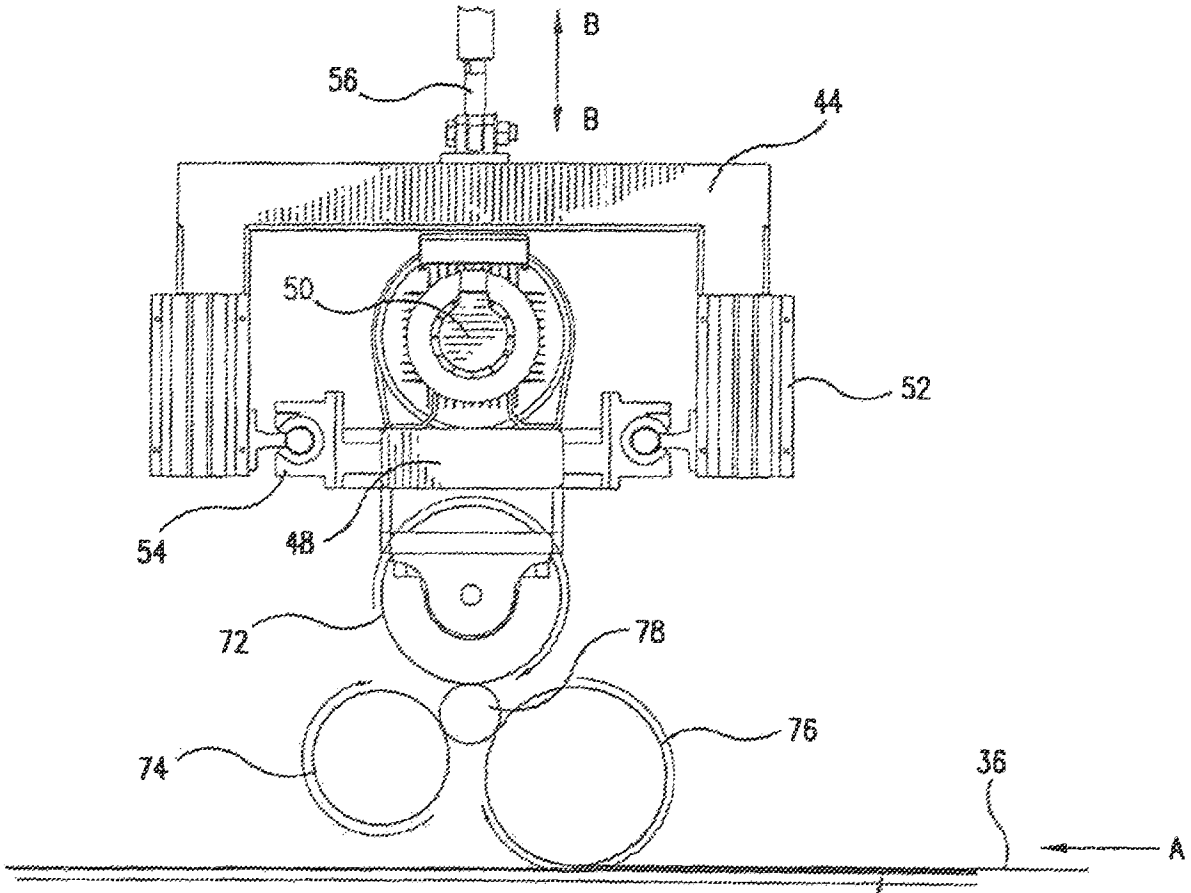
FIG. 7 is a side elevation view of an exemplary embodiment of a winding module. The drawing shows the winding module using rolls to form a rolled product via surface winding only.

FIG. 7 shows another exemplary embodiment of a winder module. The exemplary embodiment in FIG. 7 is substantially similar to the exemplary embodiment shown in FIG. 6 with the exception of having the winding process being a pure surface procedure. A drum roll 72 is located at approximately the same location as the mandrel 26 of FIG. 6. In addition, the exemplary embodiment shown in FIG. 7 also has another drum roll 74 along with a vacuum roll 76. In operation, the web 36 is conveyed by the web transport apparatus 34 in the direction of arrow A. The web transport apparatus 34 may be a vacuum conveyor or a vacuum roll. However, it is to be understood that a variety of web transport apparatus 34 may be utilized, and the present invention is not limited to one specific type. Another exemplary embodiment, for instance, may include web transport apparatus 34 that is an electrostatic belt that uses an electrostatic charge to keep the web 36 on the belt. The vacuum roll 76 draws the web 36 from the web transport apparatus 34 and pulls it against the vacuum roll 76. The web 36 is then rotated around the vacuum roll 76 until it reaches a location approximately equal distance from the drum roll 72, drum roll 74, and vacuum roll 76. At such time, the web 36 is no longer pulled by the vacuum in the vacuum roll 76 and is thus able to be rolled into a rolled product 22 by way of surface winding by the drum roll 72, drum roll 74, and vacuum roll 76. The rolled product 22 that is formed in the exemplary embodiment shown in FIG. 7 is a coreless rolled product without a cavity 78. The winding module may also be modified such that more than or fewer than three rolls are used to achieve the surface winding process. Further, the production of the rolled product 22 having a core 24 or a coreless cavity in the rolled product 22 can be achieved in other exemplary embodiments using a similar configuration as shown in FIG. 7.

In order to get the web 36 onto the mandrel 26, the mandrel 26 as shown in FIG. 6, may be a vacuum supplied mandrel. Such a vacuum mandrel 26 will pull the web 36 onto the mandrel 26 by means of a vacuum supplied through all or parts of the vacuum mandrel 26. Other ways of assisting the transfer of the web 36 onto the mandrel 26 are also possible. For instance, an air blast may be provided under the surface of the web transport apparatus 34 or a caming apparatus may be placed under the web transport apparatus 34 to propel the web 36 into contact with the mandrel 26. Further, the positioning apparatus 56 may be used to push the winding module down onto the web 36 to effect the winding.

Shown in FIG. 5 is a waste removal apparatus 200 for removing extra web 36 that results from faults such, as web breaks, and machine start ups. This waste is moved to the end of the web transfer apparatus 34 and then removed. The use of a plurality of individual modules 12 reduces the amount of waste because once a fault is detected, the affected module 12 is shut down before the rolled product is completely wound. The web is severed on the fly and a new leading edge is transferred to the next available module. Any waste is moved to the end of the web transfer apparatus 34 and then removed.

It is believed that using a web transport apparatus 34 that has a vacuum conveyor or a vacuum roll will aid in damping the mandrel 26 vibrations that occur during transfer of the web 36 onto the mandrel and also during the winding of the mandrel 26 to form a rolled product 22. Doing so will allow for higher machine speeds and hence improve the output of the rewinder 10.

Each of the winder modules 1-6 of the plurality of independent winding modules 12 do not rely on the successful operation of any of the other modules 1-6. This allows the rewinder 10 to operate whenever commonly occurring problems during the winding process arise. Such problems could include for instance web breaks, ballooned rolls, missed transfers, and core loading errors. The rewinder 10 therefore will not have to shut down whenever one or more of these problems occurs because the winding modules 1-6 can be programmed to sense a problem and work around the particular problem without shutting down. For instance, if a web break problem occurred, the rewinder 10 may perform a web cut by a cut-off module 60 and then initiate a new transfer sequence in order to start a new winding about the next available winding module 1-6. Any portion of the web 36 that was not wound would travel to the end of the web transport apparatus 34 where a waste removal apparatus 200 could be used to remove and transport the waste to a location remote from the rewinder 10. The waste removal apparatus 200 could be for instance an air conveying system. The winding module 1-6 whose winding cycle was interrupted due to the web break could then be positioned accordingly and initiate removal of the improperly formed rolled product 22. Subsequently, the winding module 1-6 could resume normal operation. During this entire time, the rewinder 10 would not have to shut down.

Exemplary embodiments can allow for the winding process to be performed at the back end of a tissue machine. In this way, the tissue web 36 can be directly converted to product sized rolls 22 which in turn would bypass the need to first wind a parent roll during the manufacturing and subsequent rewinding process.

It should be understood that the invention includes various modifications that can be made to the exemplary embodiments of the center/surface rewinder/winder described herein as come within the scope of the appended claims and their equivalents. Further, it is to be understood that the term "winder" as used in the claims is broad enough to cover both a winder and a rewinder.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A method for applying adhesive to a web being wound into a roll comprising:

spirally winding a web into a roll, the roll rotationally moving during winding;

applying adhesive to a surface of an applicator device; and moving the applicator device from a non-engagement position to an engagement position, the surface of the applicator device contacting a surface of the roll while winding of the web onto the roll continues, the adhesive transferring to the web, the surface of the applicator device moving with the rotating roll.

2. A method as defined in claim 1, wherein the applicator device includes a rotatable applicator roll, the adhesive being applied to a surface of the applicator roll.

3. A method as defined in claim 2, wherein when the surface of the applicator roll contacts the surface of the spirally wound roll, a nip is formed between the two rolls, contact between the two rolls is maintained until at least the trailing edge of the web is wound onto the spirally wound roll.

4. A method as defined in claim 1, further comprising the step of accelerating the surface of the applicator device prior to contact with the surface of the roll comprised of the spirally wound web.

5. A method as defined in claim 4, wherein the surface of the applicator device is accelerated to a speed that substantially matches a surface speed of the rotating roll prior to contact with the rotating roll.

6. A method as defined in claim 5, wherein the surface of the applicator device comprises a surface of a rotating applicator roll.

7. A method as defined in claim 1, wherein an adhesive applicator applies the adhesive to the surface of the applicator device.

8. A method as defined in claim 7, wherein the adhesive is extruded onto the surface of the applicator device so as to form a bead line.

9. A method as defined in claim 1, wherein the applicator device pivots from the non-engagement position to the engagement position.

10. A method as defined in claim 1, further comprising the step of cutting the moving web to form the trailing edge during winding of the web, the applicator device contacting the surface of the rotating roll and the web being cut in a manner such that adhesive applied to the web is located between the last two layers of the wound roll.

11. A method as defined in claim 1, wherein the web comprises a tissue web having a bulk greater than 3 cc/g.

12. A method as defined in claim 1, wherein the adhesive is applied to the surface of the applicator device while the surface of the applicator device is stationary.

13. A method as defined in claim 6, wherein the surface of the applicator roll and the spirally wound roll comprised of the web are rotated in opposite directions.

* * * * *